US005500566A

United States Patent [19]

Talmon-Gros et al.

[11] Patent Number: 5,500,566

[45] Date of Patent: Mar. 19, 1996

[54] LIGHT BULB FILAMENT DAMPENING SYSTEM

[75] Inventors: Guenter E. Talmon-Gros, Sparta, Tenn.; Donald H. Freeman, Morris Plains, N.J.; Thomas A. Flight, Poquoson, Va.; Raymond M. McCarthy, Succasunna, N.J.; Anthony E. Kendall, Cookeville, Tenn.

[73] Assignee: Cooper Industries, Inc., Houston, Tex.

[21] Appl. No.: 55,773

[22] Filed: May 3, 1993

Related U.S. Application Data

[63] Continuation of Ser. No. 803,879, Dec. 9, 1991, abandoned.

[51] Int. Cl.[6] ..... H01J 9/24

[52] U.S. Cl. ..... 313/275; 313/279; 313/269; 313/272

[58] Field of Search ..... 313/279, 277, 313/579, 269, 272, 316

[56] References Cited

U.S. PATENT DOCUMENTS

| | | | |
|---|---|---|---|
| 1,871,366 | 8/1932 | Gustin | 313/279 |
| 3,441,774 | 4/1969 | Stone et al. | 313/316 X |
| 3,486,065 | 12/1969 | Martin | 313/279 X |
| 3,764,845 | 10/1973 | De Fraeye | 313/279 X |
| 4,238,705 | 12/1980 | Thomas | 313/579 |
| 4,473,770 | 9/1984 | Baba et al. | 313/315 X |
| 4,896,074 | 1/1990 | Williams et al. | 313/272 X |

FOREIGN PATENT DOCUMENTS

| | | | |
|---|---|---|---|
| 1435979 | 5/1976 | United Kingdom | 313/279 |

*Primary Examiner*—Sandra L. O'Shea
*Assistant Examiner*—Vip Patel
*Attorney, Agent, or Firm*—Burns, Doane, Swecker & Mathis

[57] ABSTRACT

A filament dampening system for a filament in a miniature lamp includes a glass bridge formed around the lead wires and the filament dampening wire.

10 Claims, 1 Drawing Sheet

LIGHT BULB FILAMENT DAMPENING SYSTEM

This application is a continuation of application Ser. No. 07/803,879, filed Dec. 9, 1991 now abandoned.

BACKGROUND OF THE INVENTION

The present invention relates to light bulbs; more system for the filament(s) contained within light bulbs.

Miniature light bulbs come with a variety of designs; however, the lower the current ratings, the more delicate the filament and consequently, the more susceptible the filament is to vibration or shock. Such vibration or shock causes lamp filaments to break and thus render the lamp useless.

There is therefore a need in the art to provide a lamp filament dampening system which greatly reduces the sensitivity of the filament within the lamp to vibration or shock.

SUMMARY OF THE INVENTION

A dampening system for the filament in a miniature lamp includes a glass bridge. The glass bridge is formed around the lead wires and a filament dampening wire. The lead wires and the filament dampening wire are sealed in the press portion of the bulb's glass envelope.

BRIEF DESCRIPTION OF THE DRAWINGS

A better understanding of the filament dampening system of the present invention may be had by reference to the drawings wherein.

DESCRIPTION OF THE EMBODIMENTS

Figure 1:
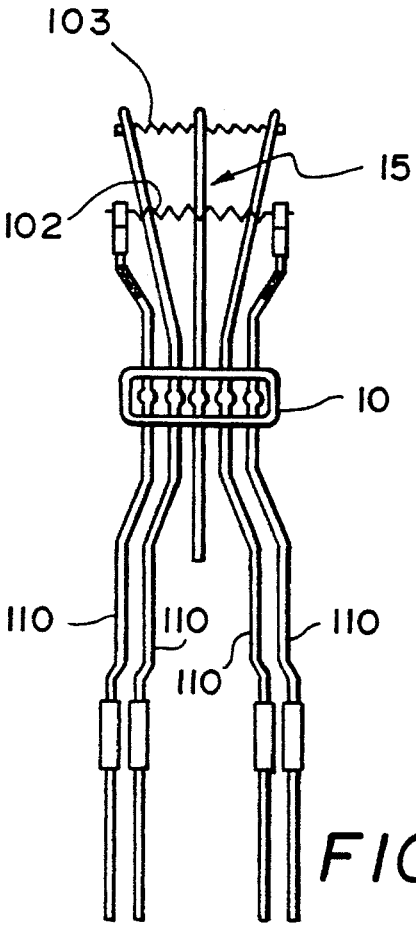
FIG. 1 is a front view of the lamp filament mounting assembly of the present invention.
Figure 2:
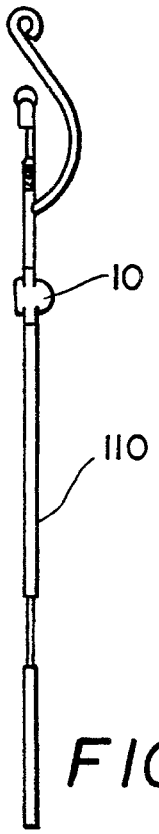
FIG. 2 is a side view of the assembly shown in FIG. 1.
Figure 3:
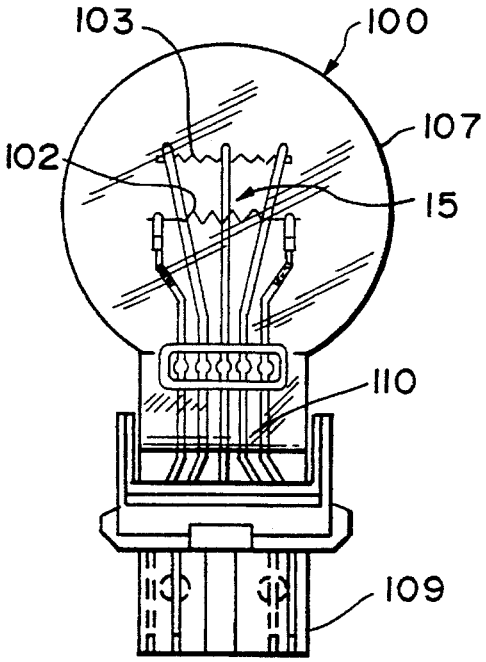
FIG. 3 is a front view of a lamp including the mounting assembly of the present invention.
Figure 4:
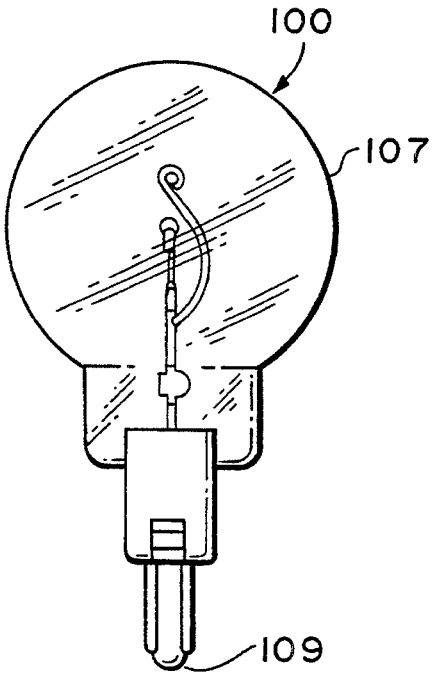
FIG. 4 is a side view of the assembly shown in FIG. 3.

A better understanding of the present invention may be had by reference to FIGS. 1 through 4 wherein it may be seen that miniature lamps 100 of the type in which this invention is used include a glass envelope 107, filaments 102 and 103 and lead wires 110 which extend through the glass envelope 107. Such filaments are either leg or continuous wound filaments. Lead wires 110 extend to filaments 102 and 103 as they supply electrical energy to filaments 102 and 103 and cause them to glow.

In the present invention a filament support wire 15 extends in a bowed pattern between filament 103 and a glass press 109 at the bottom of lamp 100. A glass bridge 10 is formed around the lead wires 110 and the filament dampening wire 15. The filament dampening wire 15 is approximately the same size (in diameter) as the lead wires 110. The lead wires 110 extend substantially in an axial direction. The filament dampening wire 15 and the lead wires 110 for the second filament 103 are arcked so as to form a bow around the first filament 102. The dampening wire 15 is fixed to a center portion of the glass bridge 10. The filament 102 is supported only at its ends by lead wires. It is the support of filament 103 provided by the glass bridge 10, dampening wire 15 and the insertion of the dampening wire 15 into the glass press 109 that dampens the vibrations and shocks associated with the movement of the light bulb 100 in its operating environment.

The lead wires 110, the filaments 102 and 103, the glass bridge 10 and the glass press 109 are all substantially in the same plane. The lead wires 110 and the dampening wire 15 enter the glass press in this plane. This feature of having both filaments being in the same plane as the glass press 109 inherently enables the bulb 100 to be inserted in either of two directions so incorrect insertion of the bulb is avoided.

There is thereby provided by the filament dampening system of the present invention a lamp filament mounting system including a glass bridge 10 which greatly reduces the sensitivity of the filaments to vibrations and shocks.

The foregoing embodiment is intended to illustrate the present invention and not limit it in spirit or scope.

I claim:

1. A lamp, comprising:

a glass envelope having a bulbous portion and a press portion;

a first lamp filament contained within said glass envelope;

a plurality of first lead wires extending substantially in an axial direction from said first filament within said bulbous portion and into said press portion;

a second lamp filament contained within said glass envelope;

a plurality of second lead wires extending from said second filament through said bulbous portion and through said press portion, said second lead wires being longer than said first lead wires;

a bridge member formed around said first and second lead wires;

said first lamp filament said second lamp filament and said bridge member are aligned in a plane extending through a center of the lamp in the axial direction wherein the plane is coplanar with the press portion; and said second lead wires are arcked around said first lamp filament;

a dampening wire extending from the second lamp filament through the bridge member to said press portion, said dampening wire being arcked around said first lamp filament; and said first and second lead wires and said dampening wire enter said press portion along the plane.

2. The lamp defined in claim 1 wherein said bridge member is made of glass.

3. The lamp defined in claim 1, wherein the dampening wire is fixed to a center portion of said bridge and said first and second lead wires are mounted on opposite sides of said dampening wire.

4. The lamp defined in claim 1, wherein the lamp is a miniature lamp.

5. The lamp defined in claim 1, wherein the filament dampening wire forms a bow around the first lamp filament between the bridge member and the second lamp filament.

6. The lamp defined in claim 1, wherein the first lamp filament is supported only at its ends by the first lead wires.

7. The lamp as defined in claim 1, wherein the dampening wire is substantially the same size as the second lead wires.

8. The lamp of claim 1, wherein a length of the dampening wire between the glass press portion and the bridge member is less than a length of the dampening wire between the second lamp filament and the bridge member.

9. A lamp, comprising:

a glass envelope having a bulbous portion and a press portion;

a first lamp filament contained within said glass envelope;

a plurality of first lead wires extending from said first filament through said bulbous portion and through said press portion;

a second lamp filament contained within said glass envelope parallel to said first lamp filament;

said first and second lamp filaments being coplanar with said press portion;

a plurality of second lead wires extending from said second filament through said bulbous portion and through said press portion, said second lead wires being longer than said first lead wires;

a bridge member formed around said first and second lead wires; and means for dampening vibrations and shocks on said second lamp filament, said dampening means including a dampening wire extending in an arcked pattern from the second lamp filament through the bridge member and then into said press portion, said dampening wire having substantially the same diameter as said first and second lead wires.

10. The lamp of claim 9, wherein a length of the dampening wire between the glass press portion and the bridge member is less than a length of the dampening wire between the second lamp filament and the bridge member.

* * * * *